United States Patent [19]

Uchitel et al.

[11] 4,402,826

[45] Sep. 6, 1983

[54] VIBRATING SCREEN

[75] Inventors: Alexandr D. Uchitel; Evgeny A. Zelov; Leonid J. Brener; Evgeny G. Baturov; Anatoly G. Derbas; Kim D. Ivchenko; Jury K. Kuevda; Ivan T. Khomich, all of Krivoi Rog, U.S.S.R.

[73] Assignee: Nauchno-Issledovatelsky I Proektny Institut Po Obogascheniju I,** U.S.S.R.

[21] Appl. No.: 318,972

[22] Filed: Nov. 6, 1981

[51] Int. Cl.[3] ..... B07B 1/34

[52] U.S. Cl. ..... 209/366.5; 209/326; 209/415

[58] Field of Search ..... 209/325, 326, 365 R, 209/366, 366.5, 367, 504, 415

[56] References Cited

U.S. PATENT DOCUMENTS 3,236,381 2/1966 Poynter ..... 209/325

3,703,236 11/1972 Spurlin et al. ..... 209/326

*Primary Examiner*—Frank Sever

*Attorney, Agent, or Firm*—Steinberg & Raskin

[57] ABSTRACT

In a vibrating screen, an oscillation driver is connected with a box carrying a screen member at a portion wherein one center of oscillation of the box is located, and is disposed relative to the screen member of the box in an opposite relationship with a bearing damper. Bearing levers supporting the box are disposed substantially perpendicular to the central axis of inertia of the latter and are adjacent the box at a portion of location of its another center of oscillation.

5 Claims, 8 Drawing Figures

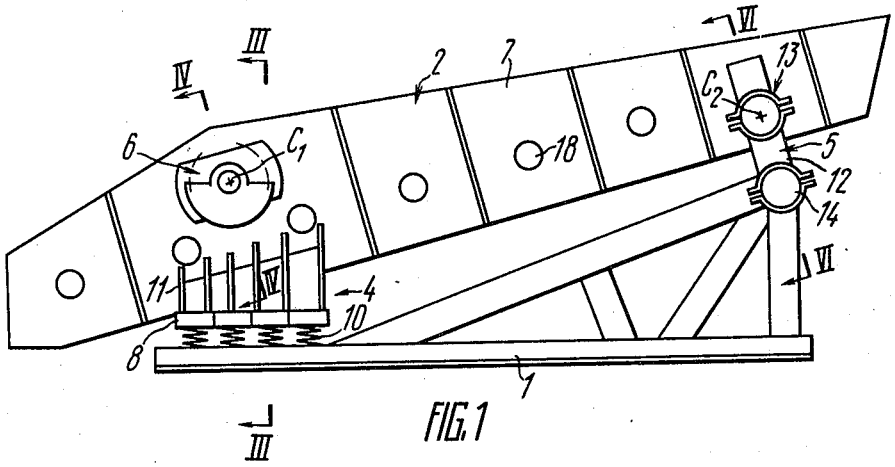
FIG. 1
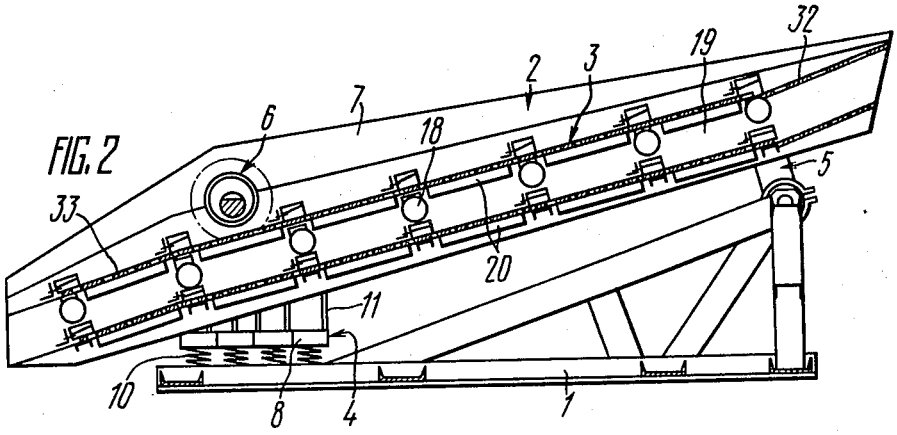
FIG. 2
FIG. 3
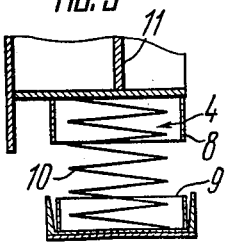
FIG. 5
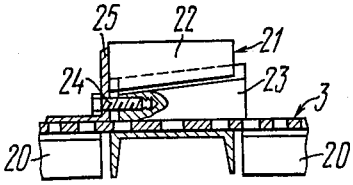
FIG. 6
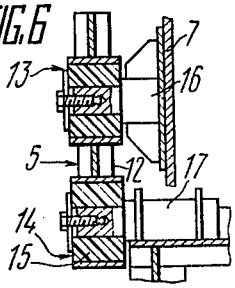

VIBRATING SCREEN

BACKGROUND OF THE INVENTION

1. Field of the Invention

The present invention relates to devices intended for separating both solid and pulp-like materials by size range. More specifically, the invention concerns the design of vibrating screens.

The invention may prove most advantageous in mining, construction, and metallurgical industries for separating ores, building materials, and metallurgical burdens respectively.

2. Prior Art

Separation of particles by size range is carried out in such devices in the course of shifting a layer over the screen. Fine fractions of the material shift within the layer under the action of vibrations till the contact with the screen and upon having reached the screen pass therethrough.

The practice of separating free-flowing and pulp-like materials by size range on vibrating screens indicates that these screens have to meet the basic requirements that the screen must ensure high separation efficiency and possess high specific throughput, which becomes possible with a high speed of fine fractions moving through the material layer till the contact with the screen, and rapid passage of those particles of fine fractions which have reached the screen, through the screen openings. At the same time, the screen must have a high degree of vibration damping, i.e. transmit the minimum amount of dynamic forces to the base.

At present, in mining, construction, and metallurgical industries, screens are utilized wherein vibration amplitudes are equal at each point of the screen, and vibration forces are directed at the same angle to the screen plane, i.e. a uniform vibration field acts along the screen length. In numerous cases, the layer height in these screens is such that during the time of movement of the material layer over the screen, fine fractions do not have enough time to go down till the contact with the screen, thereby the separation efficiency gets decreased. In order to achieve the high efficiency of separation in these screens, it is desired that the material layer being shifted be of a small height. However, in so doing the specific throughput of the screen is decreased. Thus, in such screens the requirement of ensuring the high separation efficiency simultaneously with the high specific throughput, is not met.

It is well known that the speed of fine fractions shifting through the layer of material becomes increased in the case where vibration forces act on the layer, said forces inducing pure shear stresses within the layer. When the vibration forces induce simultaneously shearing stresses and tensile and compressive stresses within the layer, the fine fractions move through the layer till the contact with the screen at a considerably lower speed. It is also known that the fine fractions, which have reached contact with the screen, pass through this screen with the highest rate in the case where an angle of throwing-up the layer above the screen is close to the right angle. Thus, to increase the speed of the fine fractions moving through the layer towards the screen, it is necessary that the screen be vibrating in the scattering plane, while to ensure the best passage of particles through the screen, the latter must vibrate in the plane perpendicular to the scattering plane.

In conventional vibrating screens, the vibration forces are directed at a certain acute angle to the scattering plane, i.e. the conditions of vibrations are not optimum either for the process of movement of the fine fractions through the layer till the contact with the screen, or for the process of passage of the particles which have reached the screen through the openings thereof.

In some cases there are applied vibrating screens possessing a vibration field which is non-uniform along the screen length, where the amplitude of vibrations and the direction of vibration forces along the screen length change in disordered manner. It is obvious that such screens do not meet the requirements.

In certain screens known in the art, the vibration field is non-uniform, and the amplitude of vibrations and the direction of the vibration force change in ordered manner along the screen length from the charging end towards the discharging one. These screens are known as the Baum screens (see Spravochnik po obogashcheniyu rud, Moscow, "Nedra", 1972, s.68). As a rule, the Baum screen comprises a box with a screen mounted thereon, supports constructed as dampers and levers inclined towards the central axis of inertia of said box, and an oscillation driver constructed in the form of a crank and connecting rod mechanism fixed on a frame and connected with said box by means of connecting rods.

Although the Baum screen does not completely meet the requirements of increasing the separation efficiency and specific throughput, since its ordered non-uniform vibration field is not optimum, its utilization allows this problem to be solved to a certain extent.

However, the Baum screen is not internally balanced and transmits the loads acting within the drive to the base, thereby making its application as highly productive industrial models impossible.

SUMMARY OF THE INVENTION

The principal object of the invention is to provide a vibrating screen having an increased, as compared with the prior art, efficiency of separation of material particles by size range accompanied by an increase in specific throughput.

An object of the invention is to provide a vibrating screen having a high degree of dynamic balancing, or, in other words, transmitting minimum dynamic loads to the base.

Another object of the invention is to provide a screen which is reliable in operation due to the reduction of stresses acting in the box elements of the screen.

The objects set forth and other objects of the present invention are attained in that in a vibrating screen comprising a frame, a box provided with a screen and hingedly connected with said frame by means of a bearing damper and bearing levers, and an oscillation driver connected with said box, according to the invention, the oscillation driver is connected with the box at a portion wherein a center of oscillation of the latter is located, and is disposed relative to the screen of the box in an opposite relationship with the bearing damper, the bearing levers being disposed substantially perpendicular to the central axis of inertia of the box and adjacent the box at a portion of location of another center of oscillation of the latter.

With such an arrangement of the oscillation driver, the levers, and the dampers it is possible to obtain a non-uniform vibration field on the box screen, wherein (in the application of a circular oscillation driver) elliptical trajectories change with the screen length from being tangent to the screen in the point of connection between the box and the levers to being close to normal relative to the screen in the point of driver installation.

At the screen portions having either tangent or close to tangent trajectories the conditions are created for increasing the speed of particles of fine fractions, moving within the layer till the contact with the screen, while at the portions having either normal or close to normal trajectories the conditions are created for rapid passage of particles which have reached the contact with the screen through the openings thereof.

It is expedient to construct the oscillation driver of the box in the vibrating screen in the form of an inertial vibrator which is to be mounted directly on said box.

Such an arrangement eliminates direct transmission of inertial forces being developed in the drive, from the drive to the frame, and due to the above arrangement of the driver and the bearing elements permits to sharply decrease transmission of these forces to the frame and, consequently, to the base.

It is possible to incline the inlet and outlet portions of the box screen, located behind the centers of oscillation of the box, to the horizon at angles being respectively greater than the angle of inclination to the horizon of the middle portion of the box screen.

Such an arrangement creates conditions for active movement of the layer of the material being separated, at the inlet and outlet portions, since the direction of vibration forces at these portions substantially differs from that of material shifting.

There is provided the possibility to dispose the axes of those hinges of said bearing levers which are at the ends adjacent the box coaxially with said one center of oscillation of the box.

The foregoing arrangement permits the attainment of a zero force in the lever hinge adjacent to the frame, i.e. transmission of dynamic forces to the frame and, consequently, to the base.

BRIEF DESCRIPTION OF THE DRAWINGS

For a fuller understanding of the invention, reference is had to the following description, taken in connection with the accompanying drawings, in which:

FIG. 1 is a general view of the vibrating screen of the invention;

FIG. 2 is a longitudinal sectional view of FIG. 1 demonstrating screen members of the screen and angles of fixing thereof to the box;

FIG. 3 is a view of FIG. 1 along the line III—III to demonstrate cross-section of an element of the bearing damper;

FIG. 5 is a view taken along the arrow A in FIG. 4 to demonstrate an assembly for fixing a screen member to the vibrating screen box;

FIG. 6 is a view of FIG. 1 along the line VI—VI to demonstrate cross-section of the bearing lever;

DESCRIPTION OF PREFERRED EMBODIMENTS OF THE INVENTION

Figure 4:
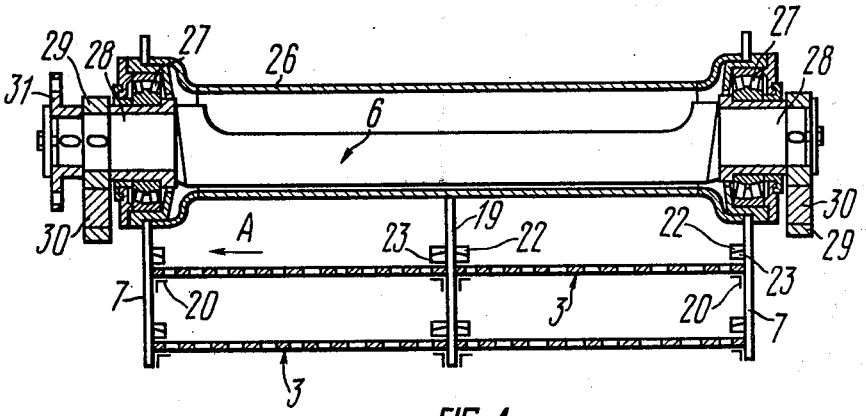
FIG. 4 is a view of FIG. 1 along the line IV—IV to demonstrate the oscillation driver.

A vibrating screen comprises a frame 1, a box 2 provided with at least one screen member 3. The box 2 is hingedly connected with the frame 1 by a bearing damper 4 and bearing levers 5. A driver 6 for oscillation of the box 2 is connected therewith. The frame 1 of the vibrating screen is mounted on a base (not shown in the Figs.).

According to the invention, the oscillation driver 6 is connected with the box 2 at a portion of location of one center $C_1$ of oscillation of the latter. The bearing levers 5 are disposed substantially perpendicular to the central axis of inertia of the box 2 and are adjacent the box 2 at a portion of location of another center $C_2$ of oscillation of the latter.

As seen in FIG. 1, the oscillation driver 6 is mounted directly on edges 7 of the box 2 (FIG. 4). However, there is possible a case where the oscillation driver 6 will be a vibrator of some other type, e.g. a crank and connecting rod mechanism (not shown in the Figs.) mounted on the frame and connected with the box 2 by means of connecting rods or tie rods (not shown in the Figs.).

The bearing damper 4 is formed by a pack of upper 8 and lower 9 cylinders wherein helical springs 10 are mounted. The upper cylinders 8 are attached to the box 2 by means of plates 11.

The bearing levers 5 are substantially cranks each of which having a T-shaped beam 12 provided with split clips of hinges 13, 14 at the ends thereof (FIG. 6). Within the clips of the hinges 13, 14 are mounted resilient bushings 15 fitted on pins 16, 17 which are rigidly attached correspondingly to the box 2 and the frame 1.

The box 2 consists of the edges 7 connected therebetween by means of transverse rods 18. The box 2 is provided with a longitudinal reinforcing rib 19. As seen in FIG. 2, within the box 2 there are mounted two screen members 3 lying on angular projections 20 and pressed thereto by means of wedge clamps 21 (FIG. 5). The wedge clamp 21 comprises stationary 22 and movable 23 wedges, the stationary wedge 22 being attached to the edge 7 while the movable wedge 23 is fixed by a bolt 24 disposed within an opening of a bearing angle 25 attached to the box 2.

According to one embodiment of the invention, the oscillation driver 6 (FIGS. 1 and 4) is constructed as an inertia vibrator 6 mounted directly on the box 2. The inertia vibrator 6 comprises a tubular housing 26 provided with bearings 27 mounted stationary therewithin. In the bearings 27 is mounted an unbalancing shaft 28. At the ends of the unbalancing shaft 28 there are provided unbalances 29 having removable plugs 30 which serve for adjusting the mass of said unbalances 29. At one end of the shaft 28, a half-coupling 31 is mounted to connect the shaft 28 with a drive (not shown in the Figs.).

According to another embodiment of the invention, an inlet 32 and outlet 33 portions of the screen members 3 of the box 2 are located behind the centers $C_1$ and $C_2$ of oscillation of the box 2 and are inclined to the horizon at angles which are correspondingly greater than the angle of inclination of the middle portion of the screen member 3 to the horizon.

As shown in FIG. 1, the axis of rotation of the hinge 13 of the bearing levers 5 coincides with the center $C_2$ of oscillation of the box 2. Such an arrangement is a preferred though not an obligatory requirement. Non-alignment of the axis of the hinge 13 with the center $C_2$ of oscillation may result in appearance of dynamic forces on the frame 1.

The above described vibrating screen operates as follows.

Figure 7:
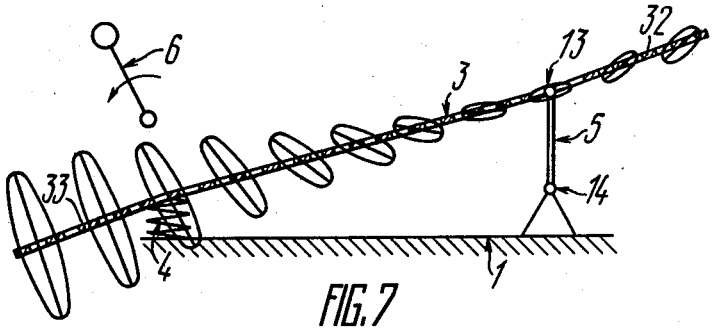
FIG. 7 is a diagram of the vibrating screen with trajectories of movement of screen member points plotted against the screen member in an enlarged scale (in driving the box by a single-shaft vibrator) and with conditional designation of disbalances.
Figure 8:
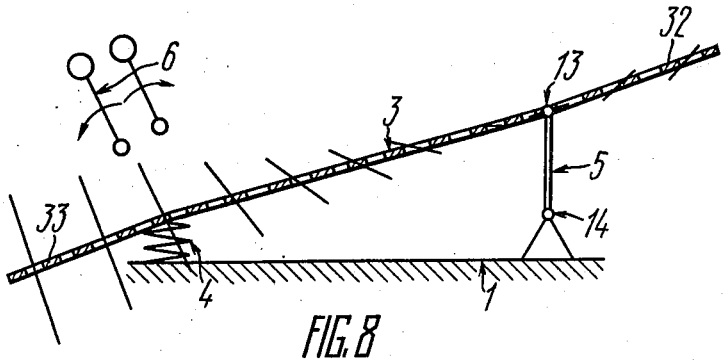
FIG. 8 is a view of FIG. 7 in the case of a self-balancing vibrator which is also shown conditionally.

In the process of operation, the unbalancing shaft 28 is set in motion by a motor via the coupling 31. The rotation of the shaft 28 generates a perturbing force resulting in the oscillatory vibrating motion of the whole box 2. Since the shaft 28 (FIGS. 7, 8) is mounted in one center $C_1$ of oscillation of the box 2 and the hinge 13 of the bearing lever 5 is mounted in the second center $C_2$ of oscillation of said box 2, the reaction force normal to said box within said hinge is equal to zero. Therefore, the displacement which is normal to the box within the hinge 13, is also equal to zero. Since the hinge 13 is mounted in the center $C_2$ of oscillation of the bearing levers 5, the force normal to the axis of said bearing levers, is equal to zero within the hinge 14. Thus, the forces transmitted from the oscillating box 2 to the frame 1 via the hinge 14 are equal to zero. Thereby, complete dynamic vibration damping is achieved in the bearing levers 5. The portion of the screen 3 near the bearing levers 5 accomplishes oscillations tangential to said screen, while the portion of said screen near the oscillation driver 6 and the dampers 4 accomplishes oscillations whose direction is close to normal to said screen 3. At the portion between the bearing levers 5 and the oscillation driver 6, the screen 3 accomplishes directed oscillations having elliptical trajectories in the case where the driver is a circular single-shaft vibrator, or rectilinear oscillations in the case where the driver is a double-shaft self-balancing vibrator (not shown in the Figs.). The angle of inclination of the greater axis of the ellipse increases from 0° to 90°.

The invention is by no means restricted to the aforementioned details which are described only as example; they may vary within the framework of the invention, as defined in the following claims.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A vibrating screen, comprising a frame;

a bearing damper;

bearing levers provided with hinges at both ends thereof;

a box having at least one screen member and hingedly connected to said frame by said bearing damper and said bearing levers, said levers being substantially perpendicular to the central axis of inertia of said box and hingedly adjoining said box at a region of one center of oscillation of said box; and an oscillation driver connected to said box and adjoining said box at a region of another center of oscillation of said box, and disposed relative to said screen member of said box in an opposite relationship to said bearing damper; the positional arrangement of said oscillation driver, levers, and damper causes, with operation of said driver, said screen to vibrate with a non-uniform vibration field such that said screen vibrates in the region of said one center of oscillation with a substantially tangential trajectory with respect to its plane, and vibrates in the region of said another center of oscillation with a substantially perpendicular trajectory with respect to its plane.

2. A vibrating screen as claimed in claim 1, wherein said oscillation driver is an inertial vibrator mounted directly on said box.

3. A vibrating screen as claimed in claim 1, wherein said screen member of said box is inclined to the horizontal at a portion between the centers of oscillation of said box and has an inlet portion and an outlet portion, said portions being disposed at corresponding angles of inclination to the horizon greater than the angle of inclination to the horizon of said screen member.

4. A vibrating screen as claimed in claim 1, wherein axes of rotation of hinges of said bearing levers at the ends adjoining said box coincide with said one center of oscillation of said box.

5. A vibrating screen, comprising a frame;

a bearing damper;

bearing levers provided with hinges at both ends thereof;

a box having at least one screen member and hingedly connected to said frame by said bearing damper and said bearing levers, said screen member being inclined to the horizontal at a portion between the centers of oscillation of said box and having an inlet portion and an outlet portion, said portions being at corresponding angles of inclination to the horizon greater than the angle of inclination to the horizon of said screen member, said bearing levers being substantially perpendicular to the central axis of inertia of said box and hingedly adjoining said box so that axes of rotation of the hinges of said levers coincide with one center of oscillation of said box; and an oscillation driver consisting of an inertial vibrator mounted directly on said box at a portion of another center of oscillation of said box, and disposed relative to said screen member of said box in an opposite relationship to said bearing damper; the positional arrangement of said oscillation driver, levers, and damper causes, with operation of said driver, said screen to vibrate with a non-uniform vibration field such that said screen vibrates in the region of said one center of oscillation with a substantially tangential trajectory with respect to its plane, and vibrates in the region of said another center of oscillation with a substantially perpendicular trajectory with respect to its plane.

* * * * *